US005295769A

United States Patent [19]

Sano

[11] Patent Number: 5,295,769

[45] Date of Patent: Mar. 22, 1994

[54] STIRRING APPARATUS FOR IMPROVING GROUND

[75] Inventor: Kunihiro Sano, Tokyo, Japan

[73] Assignee: Daisho Shinki Kabushiki Kaisha, Tokyo, Japan

[21] Appl. No.: 966,585

[22] Filed: Oct. 26, 1992

Related U.S. Application Data

[63] Continuation of Ser. No. 860,435, Mar. 30, 1992, abandoned.

[30] Foreign Application Priority Data

Nov. 15, 1991 [JP] Japan ..... 3-300168
Mar. 25, 1992 [JP] Japan ..... 4-66977

[51] Int. Cl.[5] ..... E02D 3/12

[52] U.S. Cl. ..... 405/266; 405/263; 405/269

[58] Field of Search ..... 405/266, 267, 269, 258, 405/303, 236, 237, 240, 241, 242, 243

[56] References Cited

U.S. PATENT DOCUMENTS

| | | | |
|---|---|---|---|
| 3,023,585 | 3/1962 | Liver | 405/266 |
| 3,969,902 | 7/1976 | Ichise et al. | 405/266 X |
| 4,084,383 | 4/1978 | Kukino et al. | 405/269 |
| 4,906,142 | 3/1990 | Taki et al. | 405/267 |
| 5,007,770 | 4/1991 | Simmons et al. | 405/267 X |
| 5,013,185 | 5/1991 | Taki | 405/266 |

FOREIGN PATENT DOCUMENTS

| | | | |
|---|---|---|---|
| 0221512 | 9/1990 | Japan | 405/266 |

*Primary Examiner*—Dennis L. Taylor
*Attorney, Agent, or Firm*—James H. Tilberry

[57] ABSTRACT

A stirring apparatus for solidifying earthen foundations. The apparatus comprises a tubular earth auger stirring rod driven by an earth auger drive shaft. A mixture of earth and hardening agents is shaped into a rectangular cross-sectional mass by an open-ended, four-sided rectangular casing. A plurality of resulting substantially hexahedral-shaped hardened masses comprise the foundation for a building structure.

21 Claims, 10 Drawing Sheets

STIRRING APPARATUS FOR IMPROVING GROUND

This is a continuation of application Ser. No. 07/860,435, filed Mar. 30, 1992, now abandoned.

BACKGROUND OF THE INVENTION

1. Field of the Invention

The field of this invention is the art of solidifying earth prior to the erection of a structure thereon.

2. Description of Related Art

It is known to adapt an earth auger to stir or to churn in place, rather than to excavate, a cylindrical column of earth. While the earth is being stirred in place, an earth solidifying agent, such as soil cement or cement milk, is mixed with the earth during the stirring process. The mixture of solidifying agent and earth hardens into a cylindrical shaft suitable to serve, together with a multiplicity of similar such cylindrical shafts, as a foundation for a building structure.

Since the cross section of each foundation shaft is circular and most building structures are basically rectangular, the total cross-sectional area of subjacent foundation shafts within the confines of a rectangular building structure base will be less than the cross-sectional area of the base. It has been noted that, on an average, the total cross-sectional area of cylindrical foundation shafts is approximately eighty percent of the cross-sectional area of the building structure base. As a consequence, twenty percent of the building structure is not directly supported by, or in load-bearing contact with, the foundation shafts. To compensate for this foundation bearing support differential, some builders have resorted to sinking additional foundation shafts to extend over an area wider than the building structure to be supported. This is an inefficient method of preparing a foundation.

SUMMARY OF THE INVENTION

In accordance with the present invention, upper and lower stirring blades extend laterally from the outer surface of a stirring rod connected to the lower end of an excavating drive shaft. The blades are axially spaced from each other on the stirring rod and are adapted to stir and mix a hardening agent into soil loosened by the stirring blades. An open-ended, four-sided casing of rectangular cross section is secured to sleeve means exterior of, and concentric with, the stirring rod. The sleeve means is positioned between the upper and lower stirring blades and is relatively rotatable with respect to the stirring rod. The soil and hardening agent are stirred and mixed by the lower and upper stirring blades, and the mixture is shaped into a right-angle hexahedral-like form by the casing when the stirring rod is entering the earth, as well as when it is being withdrawn. In this manner, a hardened body of rectangular cross section is prepared. The ratio of the total cross-sectional area of the hardened bodies to the area of the base of the building is improved, as is the strength of the building support. As a result, neither excessively numerous hardened columns of soil nor hardened columns of soil having excessively large diameters are necessary, and the cost of the foundation work is reduced.

While the stirring rod is penetrating the earth, the hardening agent is introduced into the casing by the lower stirring blade. During withdrawal of the stirring rod, the hardening agent is introduced by the upper blade, so timed that the mixture is sufficiently hardened that the outer boundary of the mixture is defined by the movement of the casing through the plasticized mixture. As a result, the outer surface of the mixture is substantially hexahedral in configuration, wherein the casing acts as a sliding form such as is used for reinforced concrete construction.

As aforesaid, the stirring apparatus comprises the stirring rod connected to the lower end of an excavating drive shaft, upper and lower stirring blades laterally extending from the stirring rod, and an open-ended, four-sided rectangular casing interposed between the upper and lower stirring blades. The stirring rod is provided with an upper discharge hole adjacent the upper stirring blade and a lower discharge hole adjacent the lower stirring blade to discharge the hardening agent, which is fed through a hollow cavity in the stirring rod.

When the excavating drive shaft is rotating the stirring rod, the hardening agent is discharged mainly from the lower discharge hole. The hardening agent is first stirred and mixed into the loosened soil by the lower stirring blade that is positioned at the lower discharge hole. The mixture is shaped into a box-like form by the casing, which moves in the same direction, up or down, as the stirring rod. When the stirring rod is moving downwardly, this shaped mixture is again mixed by the upper stirring blade, which is located above the casing, and which moves downwardly with the progress of the stirring rod. Conversely, when the stirring rod is withdrawn, the hardening agent is discharged mainly from the upper discharge hole. The agent is mixed into the loosened soil by the upper stirring blade located at that position. The mixture is again shaped into a box-like form by the casing, which is located below that position and moved upward with the progress of the withdrawal. The mixture is further mixed by the underlying lower stirring blade, functioning the same as does the upper stirring blade when the stirring rod is moving downwardly.

Since the mixture of the loosened soil and the hardening agent is shaped into a box-like form by the casing, some of the mixture stirred within the casing tends to adhere to the inner wall of the casing, thereby spoiling the symmetry of the flat surface which the casing is intended to form. This problem is eliminated by forming an intermediate discharge hole in the outer surface of the stirring rod located between the upper and lower discharge holes, wherein it can discharge the hardening agent against the inner wall of the casing. The intermediate hole is in communication with the inside of the stirring rod, like the upper and lower discharge holes. The discharge from the intermediate hole scrapes off the mixture of the soil and agent adhering to the inner wall of the casing when the stirring apparatus moves both downward and upward. This reduces the amount of lost mixture, improves the efficiency of the mixing, and provides a better configuration of the hardened earthen shaft.

An intermediate stirring blade extending laterally adjacent the intermediate discharge hole can be secured to the stirring rod to direct the hardening agent discharged from the intermediate discharge hole to the inner wall of the casing, so that the adhering mixture is scraped off with greater efficiency. This intermediate stirring blade also assists the stirring by the upper and lower stirring blades.

When an intermediate stirring blade and an intermediate hole are used in a preferred embodiment of the invention, an upper hole is not necessary since the intermediate hole performs the same function as the upper hole. Consequently, the upper discharge hole can be omitted.

One of the side walls of the casing is detachably connected either to the body of the casing or to the stirring rod and can be separated from the other three side walls of the casing. By placing the open side of the casing adjacent an already formed first hardened earthen shaft, a second earthen shaft in formation can be bonded to the first already-formed shaft, so that interlocking between adjacent hardened earthen bodies is achieved.

After the stirring rod reaches a desired depth, the position at which the hardening agent is discharged is changed. When the stirring rod is moving downwardly into the earth, the hardening agent is discharged from the lower discharge hole. However, when the stirring rod starts to be withdrawn, means are provided to close the lower discharge hole and to open the upper discharge hole. Concurrently, the casing again shapes the mixture into a rectangular cross section, and then the rod is withdrawn. The mixture is allowed to harden into a substantially hexahedral column of hardened earth.

OBJECTS OF THE INVENTION

It is an object of the present invention to provide stirring apparatus for forming and solidifying earthen shafts whose cross-sectional shapes are adapted to support rectangular building structures efficiently.

It is another object of the invention to provide a process for forming and solidifying earthen shafts using the inventive apparatus.

It is among other objects and features of the invention to provide apparatus for forming and hardening substantially hexahedral columns of earth suitable to provide supporting foundations for building structures.

The foregoing and other features of the invention will become apparent from the following description of preferred embodiments of the invention, with reference to the accompanying drawings.

DETAILED DESCRIPTION OF THE EMBODIMENTS

Figure 1:
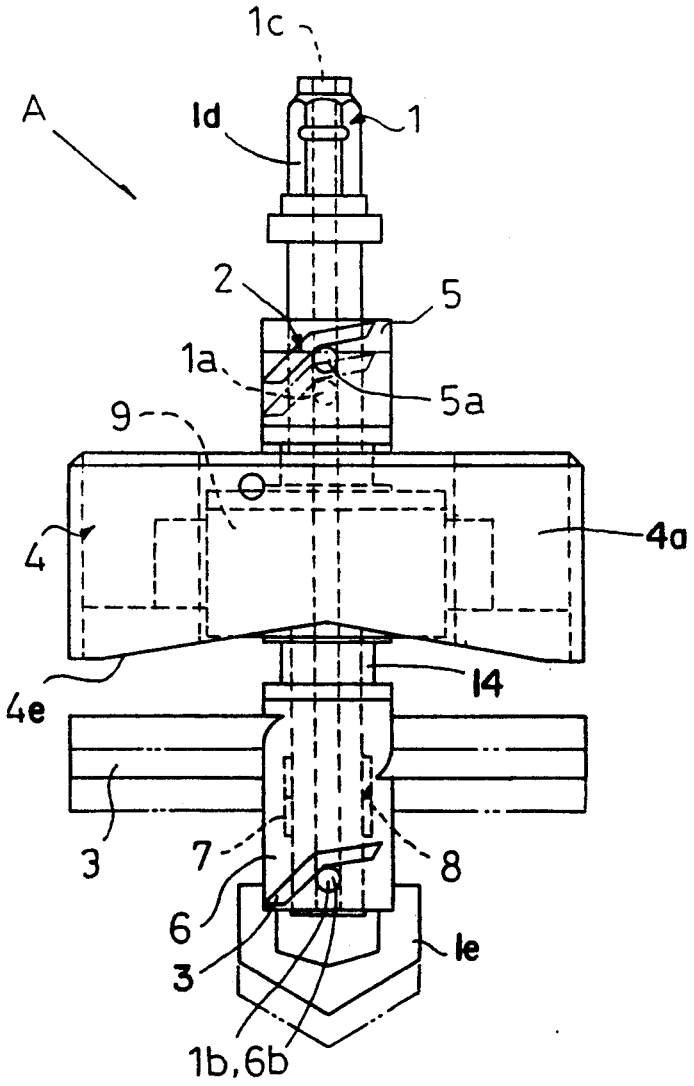
FIG. 1 is an elevational view of a preferred embodiment of a stirring apparatus in which the apparatus has a single stirring rod.
Figure 2:
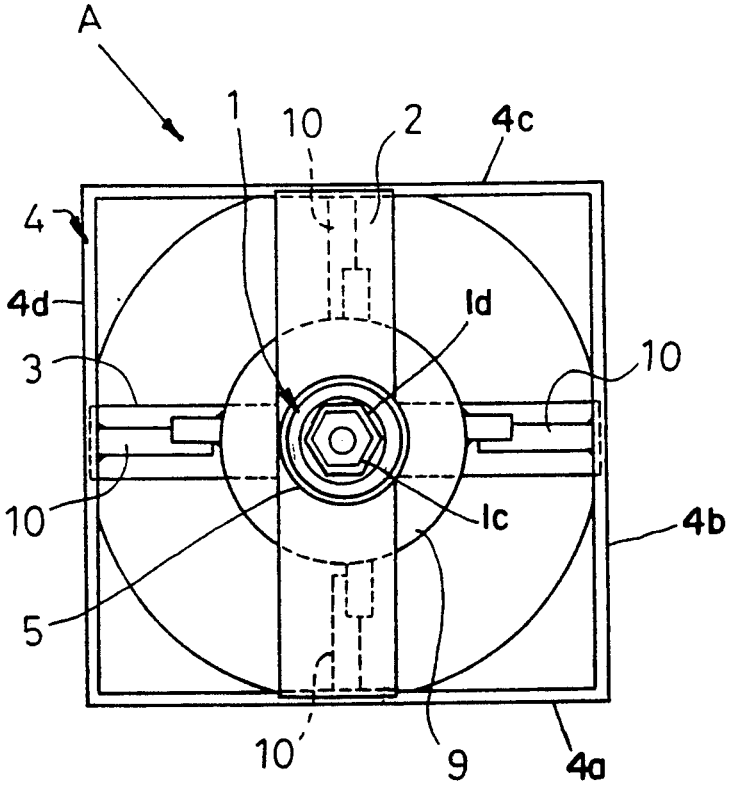
FIG. 2 is a plan view of the stirring apparatus shown in FIG. 1.

Referring to FIGS. 1 and 2, there is shown a stirring apparatus according to the invention. This apparatus is generally indicated by A and comprises an earth auger stirring rod 1 provided with a six-sided driving end 1*d* for connection with the lower drive end of an auger drive shaft (not shown); an upper stirring blade 2; a lower stirring blade 3; and an open-ended casing 4 comprising four vertical rectangular sides 4*a–d*, FIG. 2. The stirring blades 2 and 3 project laterally from the stirring rod 1. The upper blade 2 is spaced from the lower blade axially of the stirring rod 1. The stirring rod 1 is tubular with an inner passageway 1*c*. Holes 1*a* and 1*b* connect passageway 1*c* with the outer surface of the stirring rod 1 adjacent stirring blades 2 and 3, respectively. A fluid hardening agent is passed through passageway 1*c* and holes 1*a* and 1*b* for discharge into the earth being loosened by the stirring blades 2 and 3. The casing 4 is vertically positioned between the upper blade 2 and the lower blade 3 and spaced from the stirring rod 1 as shown in FIG. 2, such that the casing 4 is isolated from the rotation of the stirring rod 1. An excavating bit 1*e* is connected to the lower end of the stirring rod 1 to initially penetrate and to loosen the earth prior to penetration and stirring by stirring blades 2 and 3.

An upper housing 5 and a lower housing 6, to which the upper stirring blade 2 and the lower stirring blade 3, respectively, are secured, are telescopically mounted around the outer surface of the stirring rod 1. The upper housing 5 and the lower housing 6 are provided with an upper discharge hole 5*a* and a lower discharge hole 6*b*, respectively, at positions corresponding to the upper discharge hole 1*a* and the lower discharge hole 1*b*, respectively, of stirring rod 1. The discharge hole 5*a* is alignable with discharge hole 1*a* and discharge hole 6*b* is alignable with discharge hole 1*b*. In the illustrated embodiment, these discharge holes 1*a*, 1*b*, 5*a*, and 6*b* extend normal to the axis of the stirring rod 1 to discharge the fluid hardening agent into the earth previously loosened and stirred by stirring blades 2 and 3.

The upper stirring blade 2 and the lower stirring blade 3 extend laterally adjacent the upper discharge hole 5*a* and the lower discharge hole 6*b*, respectively, formed in the upper housing 5 and the lower housing 6, respectively. Consequently, the stirring blades 2 and 3 also act to disperse the hardening agent discharged into the loosened earth.

In order to perform the stirring efficiently, the stirring apparatus A discharges the hardening agent primarily from the lower discharge hole 1*b* while the stirring rod 1 is being driven into the earth and primarily from the upper discharge hole 1*a* when the stirring rod 1 is being withdrawn from the earth. The hardening agent discharged from the lower discharge hole 1*b* is stirred with the lower stirring blade 3 until the stirring rod 1 reaches a predetermined depth in the earth, and then by the upper stirring blade 2 while the stirring rod 1 is being withdrawn. The hardening agent is discharged from the upper discharge hole 1*a* when the stirring rod 1 is being withdrawn and is stirred with the upper blade 2 to be followed by stirring by the lower blade 3 after the discharging of the hardening agent. In this way, the hardening agent is efficiently mixed into the loosened and stirred earth both during the advancing and withdrawing of stirring rod 1 and blades 2 and 3.

In the illustrated embodiment, the housings 5 and 6 are slidably fitted on stirring rod 1 so that holes 1*a* and 1*b* are alternately opened and closed by housings 5 and 6. Thus, as shown in FIG. 1, as the stirring rod 1 penetrates the earth, the friction of the earth against housings 5 and 6 causes them to shift vertically up on stirring rod 1, causing hole 6*b* to align with hole 1*b* and hole 5*a* to shift out of alignment with hole 1*a*. In this first mode, hardening agent is blocked from passing through holes 1*a* and 5*a* and is permitted to pass through holes 1*b* and 6*b*. When the stirring rod 1 is withdrawn, housings 5 and 6 are shifted downwardly due to friction with the loosened earth, whereupon the relationship of holes 1*a* and 5*a*, and 1*b* and 6*b* reverse. Hole 5*a* is shifted into alignment with hole 1*a* and hole 6*b* is shifted out of alignment with hole 1*b*. Thus, hole 1*a* is opened and hole 1*b* is closed to flow of the hardening agent.

The upper housing 5 and the lower housing 6 are connected together by sleeve 14, as shown in FIG. 1. A tongue-like detent 7 protrudes from the outer surface of the stirring rod 1 and a groove 8 in housing 6 receives detent 7 which permits sliding movement therebetween because it is longer than the detent 7. Since housings 5 and 6 are rigidly connected together, the detent 7 and the groove 8 enable the upper housing 5 and the lower housing 6 to shift vertically in unison a predetermined controlled distance on the body of the stirring rod 1. The difference in length between the groove 8 and the detent 7 provides the stroke of the movement of the housings 5 and 6 relative to the stirring rod 1.

FIG. 1 indicates the positions of the upper housing 5 and the lower housing 6 when the stirring rod 1 is being driven into the earth. In this condition, the housings 5 and 6 shift upwardly relative to the stirring rod 1 by the resistance of the loosened earth. The lower end of the groove 8 engages the lower end of the detent 7, which causes both housings 5 and 6 to shift upwardly in unison on stirring rod 1, the distance defined by the differential between the length of the detent 7 and the groove 8. The lower discharge hole 6*b* in the lower housing 6 registers with the lower discharge hole 1*b* in the stirring rod 1 as shown, and the upper discharge hole 5*a* is shifted beyond alignment with upper discharge hole 1*a*. Since the upper discharge hole 1*a* is closed by the upper housing 5, the hardening agent can be discharged only through the lower discharge holes 1*b* and 6*b*.

Conversely, when the stirring rod 1 is being withdrawn, the upper housing 5 and the lower housing 6 shift downwardly relative to the stirring rod 1. The upper discharge hole 5*a* registers with the upper discharge hole 1*a* and the lower housing 6 closes the lower discharge hole 1*b*. The hardening agent is therefore discharged only from the upper discharge holes 1*a* and 5*a*.

As shown in FIGS. 1 and 2, bearing 9 slip-fits over stirring rod 1 to isolate the casing 4 from rotation of the stirring rod 1. The casing 4 is welded or bolted to horizontal brace members 10 extending laterally from the bearing 9. The resistance of loosened earth prevents the casing 4 from turning with the stirring rod 1.

As shown, the casing 4 is large enough to permit satisfactory molding of the mixture of the loosened earth and the hardening agent during movement of the stirring rod 1. The lower end of the casing 4 is sawtoothed, as shown in FIG. 1 at 4*e*, to reduce the resistance of the loosened earth when the stirring rod 1 is urged downward. When the stirring rod 1 engages the earth, the knife edge 4*e* of the casing 4 cuts the mixture of the loosened earth and the hardening agent along the outer surface of the casing. At the same time, the mixture is forced into the casing 4 by the knife edge 4*e* and is formed by the casing into a substantially hexahedral shape. When the stirring rod 1 is withdrawn, the mixture is once again stirred and reshaped into a substantially hexahedral mass by the casing 4.

Figure 3:
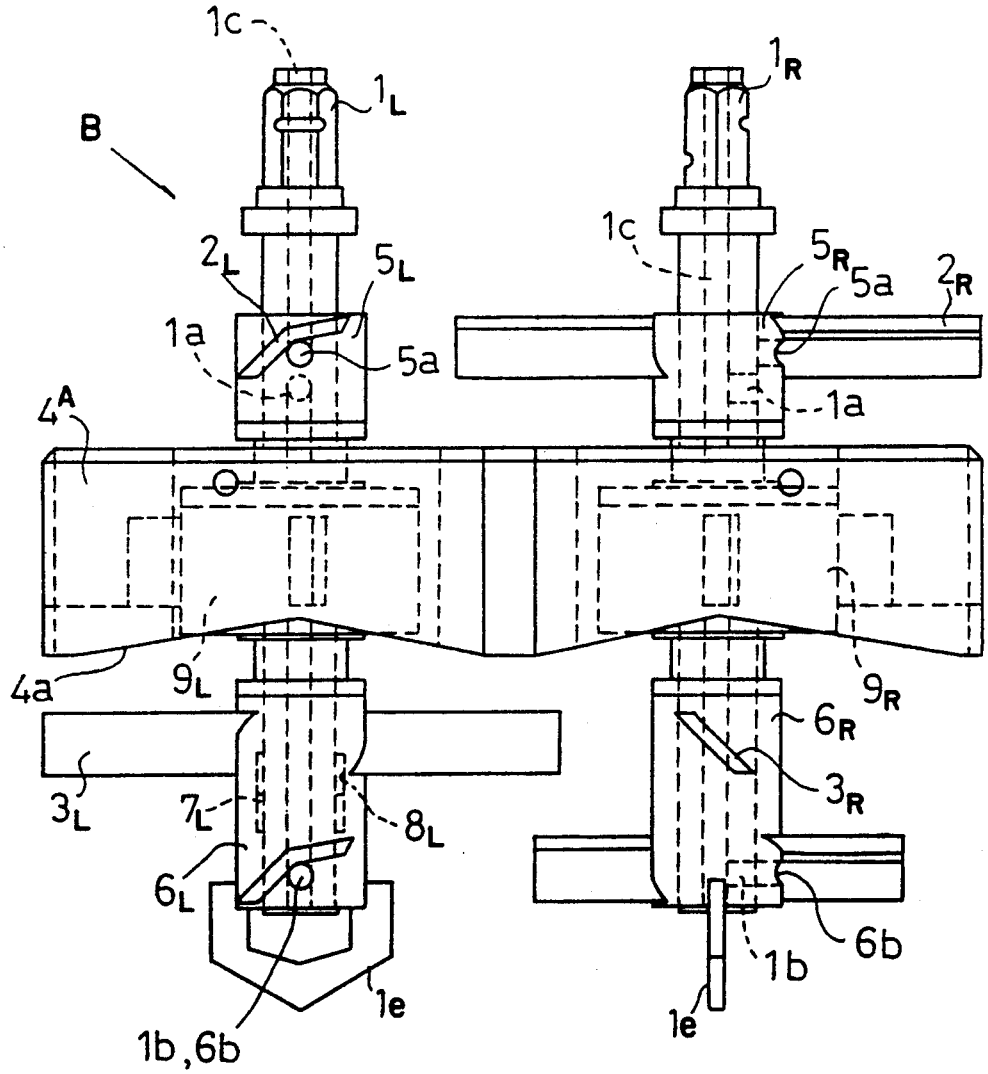
FIG. 3 is an elevational view of a modification of the stirring apparatus shown in FIGS. 1 and 2, wherein the apparatus is provided with two juxtaposed stirring rods.
Figure 4:
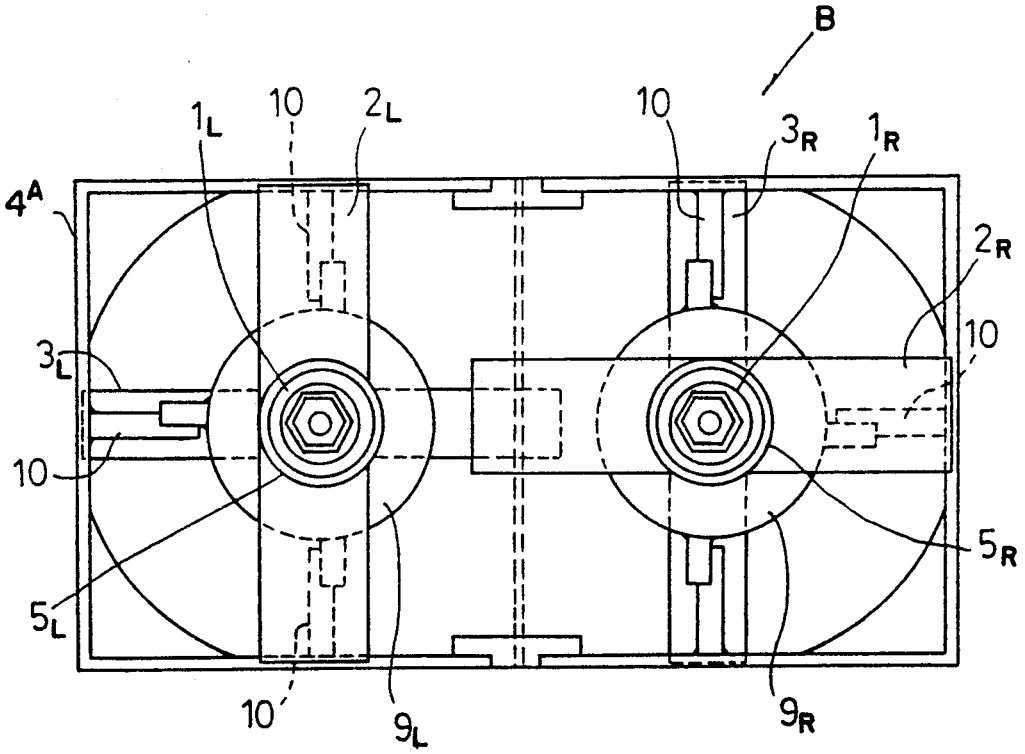
FIG. 4 is a plan view of the stirring apparatus shown in FIG. 3.

Referring next to FIGS. 3 and 4, there is shown a twin-auger stirring apparatus B in which stirring rods 1L and 1R are juxtaposed. This apparatus B is similar to the single-auger type stirring apparatus A described previously except that the casing 4A has an elongated longitudinal axis and a foreshortened tranverse axis.

Figure 5:
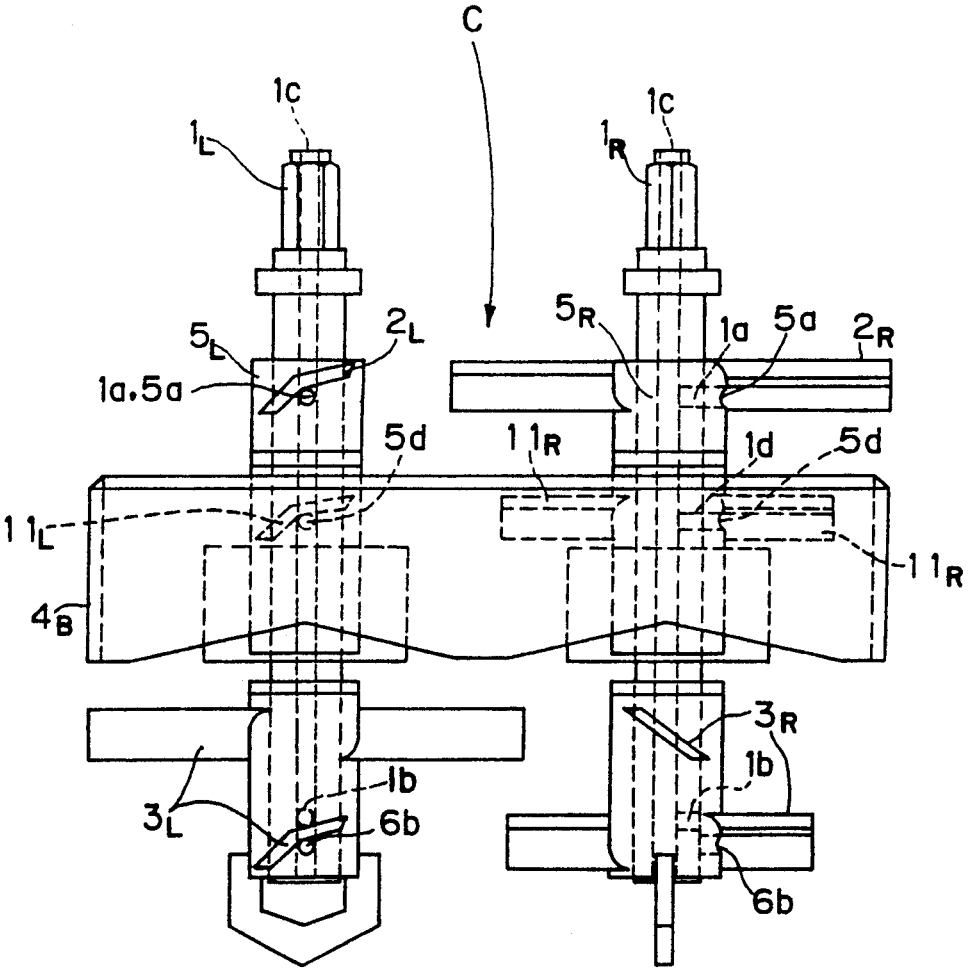
FIG. 5 is an elevational view similar to FIG. 3, but in which each stirring rod is provided with an intermediate discharge port and an intermediate stirring blade extending laterally from the stirring rod adjacent the intermediate discharge port.
Figure 6:
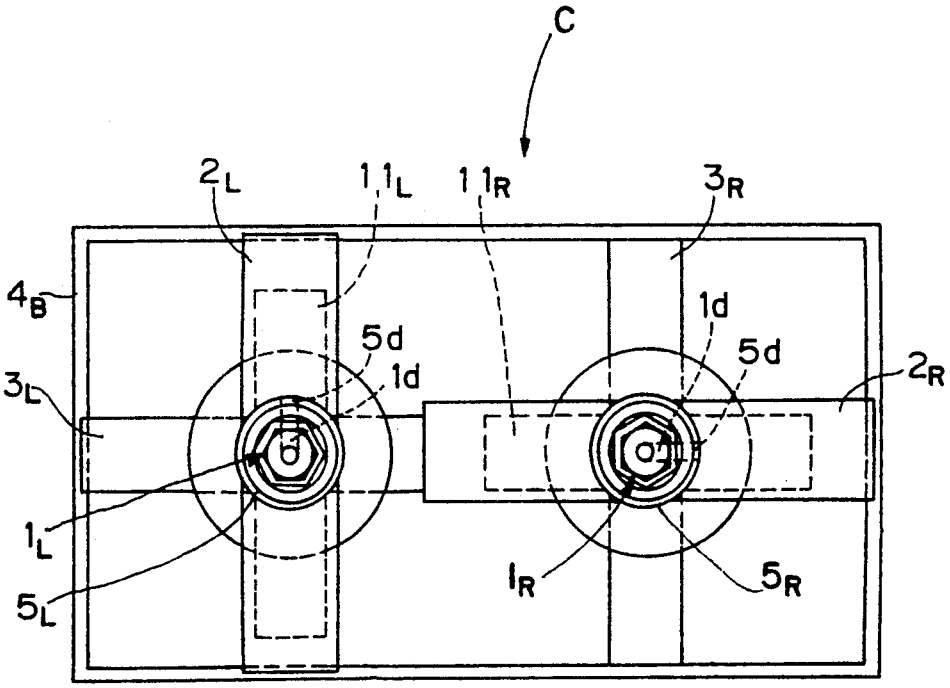
FIG. 6 is a plan view of the stirring apparatus shown in FIG. 5.
Figure 7:
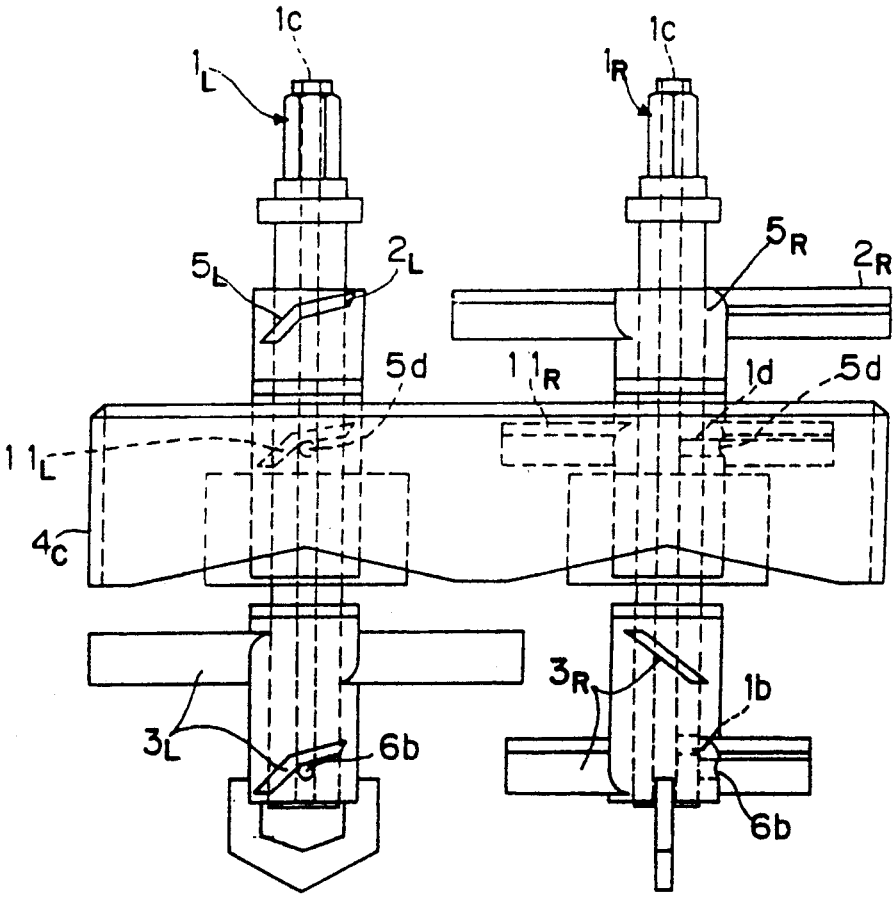
FIG. 7 is an elevational view similar to FIG. 5, but in which no upper discharge ports are provided.

Referring to FIGS. 5, 6 and 7, there is shown a stirring apparatus C which is similar to the apparatuses A and B except that a vertically elongated intermediate discharge hole 1*d* is formed in each stirring rod 1 between the upper discharge hole 1*a* and the lower discharge hole 1*b*. The hardening agent is discharged from this intermediate hole 1*d* through intermediate hole 5*d* of upper housing 5 toward the inner wall of the casing 4B to prevent or reduce adhesion of the loosened earth or the mixture to the inner wall of the casing 4B, thereby enhancing the efficiency of the mixing of the earth and hardening agent. The hardening agent is discharged from intermediate holes 1*d* and 5*d* during both downward and upward movement of the stirring rod 1.

The discharge from the intermediate holes 1*d* peels the loosened earth and/or the mixture from the inner wall of the casing 4B. This peeling operation is most efficiently performed while the stirring rods are being withdrawn, i.e., during upward movement. As aforesaid, in the structure shown in FIG. 5, the upper housing 5 is formed with intermediate discharge holes 5*d* which register with the intermediate discharge holes 1*d* when the stirring rods 1 are being withdrawn. In this way, the hardening agent is discharged from these intermediate holes as well as from the upper discharge holes 1*a* and 5*a*. However, either or both of the intermediate discharge holes 1*d* and 5*d* in the stirring rods 1 can axially take the form of vertically elongated slots wherein the hardening agent can then be discharged from the intermediate holes 1*d* and 5*d* whether the stirring rods 1 are moving upward or downward.

In the illustrated embodiments, intermediate stirring blades 11 are adjacent to, and extend laterally from, the intermediate discharge holes 1*d* and 5*d* to guide the hardening agent discharged from the intermediate discharge holes 1*d* and 5*d* to the inner wall of the casing 4B. The intermediate blades 11 also serve to assist the stirring of the lower stirring blades 3 when the stirring rods 1 are being lowered and to assist the stirring of the upper stirring blades 2 when the stirring rods 1 are being elevated.

Since the intermediate stirring blades 11 stir the mixture simultaneously with the hardening discharge from the intermediate discharge holes 1*d* and 5*d*, the intermediate discharge holes 1*d* and 5*d* perform the function of the upper discharge holes 1*a* and 5*a*. Consequently, in the embodiment of FIG. 7, the upper discharge holes 1*a* and 5*a* may be eliminated.

Figure 8:
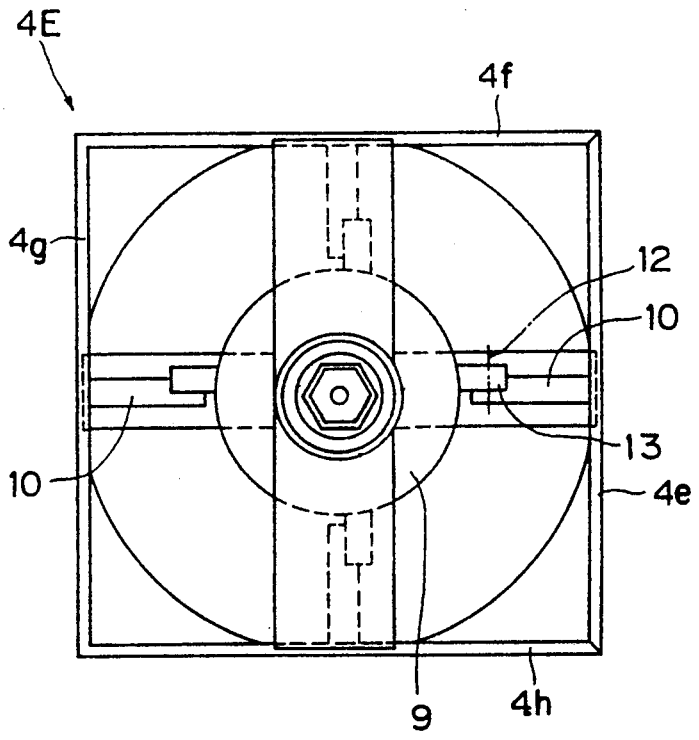
FIG. 8 is a plan view of the casing of the stirring apparatus shown in FIGS. 1 and 2, and in which the casing is detachably connected to the stirring rod.
Figure 9:
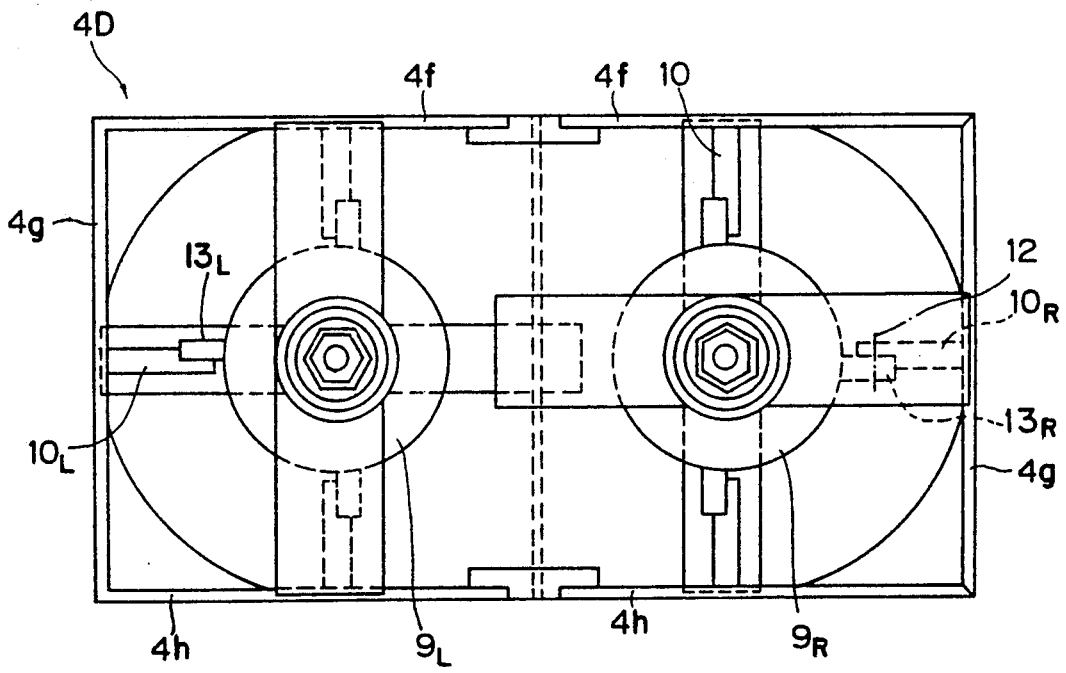
FIG. 9 is a plan view of the casing of the stirring apparatus shown in FIGS. 3 and 4, in which the casing is detachably connected to the stirring rods.
Figure 10:
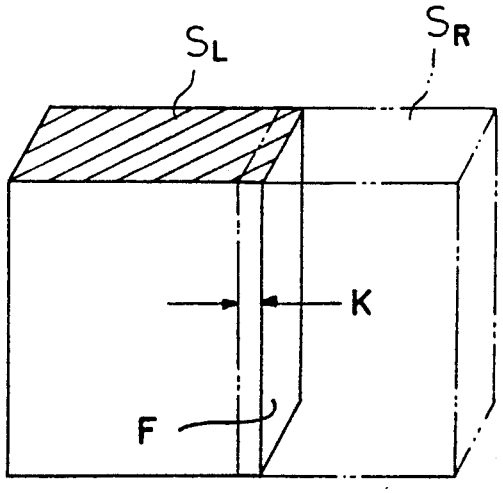
FIG. 10 is a perspective view of completed hardened hexahedral columns of earth which are bonded together by means of a modified casing in accordance with a preferred embodiment of the invention.

In the embodiment shown in FIG. 8, side 4*e* can be detached from sides 4*f*, *g* and *h* of a pair of casings to form the expanded casing 4D of FIG. 9. In another embodiment of the invention, side 4*e* of FIG. 8 is detached from sides 4*f*, *g* and *h* so that casing 4E can be used in the lapping process shown in FIG. 10. Therein shown is semi-hardened earthen shaft S-L to which a second hardened earthen shaft S-R is to be lapped and bonded. The procedure is substantially the same as the procedure described with respect to FIGS. 1 and 2 except that the three-sided casing is positioned with the open side adjacent the vertical face F to overlap vertical face F by the lateral distance K. After earthen shaft S-R has been completed, the common portions of shafts S-R and S-L, indicated at K, are then permitted to harden together, whereby shaft S-R is permanently bonded to shaft S-L. This procedure, of course, can then be repeated with earthen shaft S-R being the semi-hardened shaft to which a third earthen shaft can be lapped and bonded in the same manner that earthen shaft S-R was previously bonded to earthen shaft S-L.

The two earthen shafts S-L and S-R can also be formed simultaneously with the apparatus shown in FIGS. 3 through 7, 9 and 10, as previously described. By removing one side 4*g* of FIG. 9, the lapping process can be practiced by forming rectangular shafts rather than the substantially square shafts of FIG. 10, as formed by the apparatus of FIG. 8.

The specification and drawings disclose preferred embodiments of the invention. However, various features, details and elements may be changed or eliminated without departing from the invention as defined in the accompanying claims.

What is claimed is:

1. A stirring apparatus for improving ground by stirring a consolidating agent into excavated soil with an excavating rod when ground is excavated by the rod and also when the rod is withdrawn and by shaping the resulting mixture into a rectangular cross section, said stirring apparatus comprising:

a rod body connected with the front end of the excavating rod;

an upper stirring blade and a lower stirring blade which protrude from the outer surface of the rod body and are spaced from each other axially of the rod body;

an upper discharge hole and a lower discharge hole that are formed in the outer surface of the rod body at the positions at which the upper and lower stirring blades protrude, respectively, for forcing the consolidating agent into the excavated hole through the rod body; and a casing held at a height between the upper and lower stirring blades and spaced from the outer surface of the rod body so as to be isolated from rotation of the rod body.

2. A stirring apparatus for improving ground as set forth in claim 1, wherein the outer surface of the rod body is provided with an intermediate discharge hole at a height between the upper and lower stirring blades to discharge the consolidating agent toward the inner wall of the casing.

3. A stirring apparatus for improving ground as set forth in claim 2, wherein an intermediate stirring blade protrudes in the longitudinal direction of the intermediate discharge hole at the height of the intermediate discharge hole to guide the discharged consolidating agent and to assist the stirring of the upper and lower stirring blades.

4. A stirring apparatus for improving ground as set forth in claim 3, wherein the intermediate discharge hole acts also as the upper discharge hole.

5. A stirring apparatus for improving ground as set forth in claim wherein a part of the casing is detachably connected either to the body of the casing or to the rod body and can be separated from the body of the casing.

6. A process for improving ground with a stirring apparatus having a rod body connected with the front end of an excavating rod, an upper stirring blade protruding from the outer surface of the rod body, a lower stirring blade protruding from the outer surface of the rod body and spaced from the upper stirring blade axially of the rod body, an upper discharge hole and a lower discharge hole that are formed in the outer surface of the rod body at the positions at which the upper and lower stirring blade protrude, respectively, for forcing the consolidating agent into the excavated hole through the rod body, and a casing held at a height between the upper and lower stirring blades and spaced from the outer surface of the rod body so as to be isolated from rotation of the rod body, said process comprising the steps of:

rotating the excavating rod connected with the stirring apparatus;

discharging a consolidating agent at least from the lower discharge hole in the rod body;

stirring excavated soil and the consolidating agent with the upper and lower stirring blades;

causing the excavation to proceed while shaping the mixture of the excavated soil and the consolidating agent stirred with the lower stirring blade into the cross section of the casing which drops after the stirring;

discharging the consolidating agent at least from the upper discharge hole after the excavating rod reaches a desired depth;

stirring the mixture of the soil and the agent again with the upper and lower stirring blades; and withdrawing the excavating rod while shaping the mixture stirred with the upper stirring blade into a boxlike form by the casing that is elevated after the stirring, thus creating a consolidated body of a rectangular cross section.

7. A process for improving ground as set forth in claim 6, wherein the outer surface of the rod body is provided with an intermediate discharge hole at a height between the upper and lower stirring blades to discharge the consolidating agent toward the inner wall of the casing.

8. A process for improving ground as set forth in claim 7, wherein the stirring apparatus has an intermediate stirring blade protruding at the height of the intermediate discharge hole to guide the discharged consolidating agent and to assist the stirring of the upper and lower stirring blades.

9. A process for improving ground as set forth in claim 8, wherein the intermediate discharge hole acts also as the upper discharge hole.

10. A process for improving ground as set forth in claim 6, wherein a part of the casing is detachably connected either to the body of the casing or to the rod body and can be separated from the body of the casing.

11. Apparatus for forming hardened shafts of earth to provide foundations for building structures comprising:

a rotatable tubular earth auger having a longitudinal axis; means to vertically position and to rotate said tubular earth auger about said longitudinal axis; an upper earth-stirring blade sleeve slidably fitted about said rotatable tubular earth auger to freely shift along said longitudinal axis; an upper earth-stirring blade secured to and projecting laterally from said upper earth-stirring blade sleeve; a lower earth-stirring blade sleeve slidably fitted about said rotatable tubular earth auger to freely shift along said longitudinal axis; a lower earth-stirring blade secured to and projecting laterally from said lower earth-stirring blade sleeve, said upper and lower stirring blade sleeves being integrally secured together and vertically spaced apart along said longitudinal axis; an upper hardening agent discharge hole in said tubular earth auger adjacent said upper stirring blade sleeve; an upper hardening agent discharge hole in said upper earth-stirring blade sleeve in longitudinal axial alignment with said upper hardening agent discharge hole in said tubular earth auger; a lower hardening agent discharge hole in said tubular earth auger adjacent said lower stirring blade sleeve; a lower hardening agent discharge hole in said lower earth-stirring blade sleeve in longitudinal axial alignment with said lower hardening agent discharge hole in said tubular earth auger; said upper discharge hole in said upper sleeve being concentrically alignable with said upper discharge hole in said tubular earth auger by shifting said sleeves, said lower discharge hole in said lower sleeve being concentrically alignable with said lower discharge hole in said tubular earth auger by shifting said sleeves, said upper and lower discharge holes being so spaced apart that when said upper discharge holes are in concentric alignment said lower discharge holes are non-aligned, and when said lower discharge holes are in concentric alignment said upper discharge holes are non-aligned; means to prevent rotation of said sleeves about said tubular earth auger and to delimit shifting of said sleeves upwardly to concentrically align said upper discharge holes and to simultaneously non-align said lower discharge holes, and to delimit shifting of said sleeves downwardly to concentrically align said lower discharge holes and to simultaneously non-align said upper discharge holes, wherein said sleeves shift upwardly when said auger penetrates the earth and shift downwardly when said earth auger is withdrawn from the earth; a support sleeve slidably fitted about said tubular earth auger to provide free relative rotation between said tubular earth auger and said support sleeve; detent means on said tubular earth auger to prevent vertical shifting of said support sleeve on said tubular earth auger; an open-minded rectangular four-sided casing supported on said support sleeve wherein said earth auger is free to rotatably penetrate the earth while said open-ended rectangular four-sided casing is prevented from rotating with said earth auger by frictional and pressure contact between said open-ended rectangular four-sided casing and the earth; and an auger bit secured to the lower end of said tubular earth auger adapted to penetrate the earth when said tubular earth auger is rotated.

12. The apparatus of claim 11, wherein said casing is positioned on said tubular earth auger intermediate said stirring blades.

13. The apparatus of claim 11, including an intermediate discharge hole in said tubular earth auger adapted to remain open irrespective of the open/close status of said upper and lower discharge holes.

14. The apparatus of claim 11, including means to pass a fluid hardening agent through the interior of said tubular earth auger for selective discharge through said upper and lower discharge holes.

15. The apparatus of claim 13, wherein said intermediate discharge hole is adapted to direct a hardening agent against the interior sides of said casing.

16. The apparatus of claim 15, including an intermediate stirring blade secured to and projecting laterally from said tubular earth auger adjacent said intermediate discharge hole and adapted to direct a hardening agent from said intermediate discharge hole against the interior sides of said casing.

17. The apparatus of claim 16, wherein said casing is supported on and enclosed both of said tandem tubular earth augers.

18. The apparatus of claim 16, wherein said tandem earth augers are each provided with an intermediate stirring blade and an intermediate discharge hole.

19. The apparatus of claim 11, wherein one of said four sides is removable to form a three-sided casing.

20. The apparatus of claim 19, wherein said three-sided casing is joinable with a second three-sided casing to form an enlarged casing.

21. The apparatus of claim 11, wherein said means to alternately open and close said upper and lower discharge holes comprises upper and lower sleeves fitted about said tubular earth auger for sliding engagement therewith and rigidly interconnected to shift vertically on said tubular earth auger in unison; an upper discharge hole in said upper sleeve; and a lower discharge hole in said lower sleeve; said upper sleeve discharge hole being alignable with said tubular earth auger upper discharge hole; said lower discharge hole in said lower sleeve being alignable with said tubular earth auger lower discharge hole; said upper and lower discharge holes being so spaced apart that when said upper discharge holes are aligned said lower discharge holes are closed by misalignment and when said lower discharge holes are aligned, said upper discharge holes are closed by misalignment.

* * * * *